United States Patent [19]

Vipond

[11] 4,079,266

[45] Mar. 14, 1978

[54] ELECTRONIC CONTROL FOR AUTOMATIC DEVELOPABILITY SYSTEM

[75] Inventor: Edward W. Vipond, Macedon, N.Y.

[73] Assignee: Xerox Corporation, Stamford, Conn.

[21] Appl. No.: 773,645

[22] Filed: Mar. 2, 1977

[51] Int. Cl.[2] ..... H01H 35/00

[52] U.S. Cl. ..... 307/116; 307/117

[58] Field of Search ..... 307/117, 116, 118

[56] References Cited

U.S. PATENT DOCUMENTS 3,509,359 4/1970 Embling ..... 307/117

*Primary Examiner*—Robert K. Schaefer
*Assistant Examiner*—Eugene S. Indyk
*Attorney, Agent, or Firm*—J. J. Ralabate; M. H. Shanahan; B. J. Lacomis

[57] ABSTRACT

An electronic circuit for controlling a process monitoring arrangement wherein electronic gates respond jointly to oscillator produced pulse trains and an abnormal condition indication signal to either alternately cycle a pair of switching transistors in response to normal process conditions or to hold the switching transistors constant in response to abnormal process conditions.

5 Claims, 2 Drawing Figures

ELECTRONIC CONTROL FOR AUTOMATIC DEVELOPABILITY SYSTEM

BACKGROUND OF THE INVENTION

This invention relates to electronic circuits for controlling a process monitoring system and specifically to a control circuit for a toner dispensing system in a xerographic machine. More particularly, this invention is directed to electronic circuits usable with the automatic developability control arrangement disclosed in concurrently filed application Ser. No. 773,646, in the joint names of Edward W. Vipond and Donald J. Weikel, Jr. and entitled "Developability Control Arrangement."

This invention is generally directed to improvements in developability control systems of the type described in U.S. Pat. Nos. 3,635,373 and 3,727,065, among others which employ a sensor including two parallel spaced translucent electrically conductive plates between which developer material including charged dry ink particles or toner is made to flow. The plates are coupled to an electrical circuit for producing an electric field between the plates to cause the deposition of toner on the surfaces of the plates. In these systems a high intensity developing field is maintained substantially at all times between the plates but the sense or direction of the field is reversed in direction at a preselected rate. The charged toner particles contained in the developer material flowing through the sensor are thus first attracted, then repelled from each of the plates by the reversing field. A light source is located on one side of the two plates while a first photocell is located at the other side to sense the optical density on the two plates at all operating times. The output of the first photocell is compared with the output of a second photocell separated from the first light source by a filter to cause the dispensing of toner to the developer at appropriate times based on a comparison of the output signals of the photocells.

The problem associated with prior art arrangements of the above noted type is that under certain ambient conditions a large accumulation of toner collects on the plates and remains there for an excessively long period before being removed by the cascading action of developer. More specifically, in the prior art systems, it was thought that sufficient cleaning of the plates was accomplished by periodically reversing the direction of the electric field between the plates. Thus, each cycle of the sensor included a time when one of the plates attracted toner while the other repelled it, followed by a time when the other plate attracted toner while the first attracting plate repelled it. During each sensing cycle each of the plates attracted toner particles for half the cycle time and repelled toner particles for the other half of the cycle. Cleaning, in the above prior art arrangements, was thought to be accomplished at a plate which, at the given moment, had a repelling field for toner, as determined by the polarity of the toner charge and difference in potential between the plates.

It has been found, however, that while the above noted cleaning action takes place under normal condition, under certain conditions of humidity and temperature excessive clouding of the test plates occurs despite the continued reversal of the electric field. This excessive clouding of the plates results in a low level of light transmittal therethrough to a sensing photocell which, in turn, shuts off the toner dispenser for a long period of time. Eventually, the depletion of toner in the developer mix results in a cleaning of the plates, but not until the concentration of toner is below specification resulting in poor copy quality. When the plates are eventually cleaned the system responds by turning the toner dispenser but tends to overcompensate due to severe deplation in toner resulting from the long time period it has been off. These "undershoot" and "overshoot" periods of operation lead to a temporary loss of control of the development system.

The above noted excessive clouding has been found to be more pronounced as the development plate field reversal is reduced. The frequency at which the electric fields are reversed is selected so that sufficient time is allowed for a good sample of toner to deposit on the test plates. In prior art arrangements, a frequency of approximately 1 Hz has been employed. In order to obtain a more densely developed test patch, to thereby increase the accuracy of the system, lower frequencies are required. This latter condition, while improving the accuracy of the system, has the disadvantage of more easily permitting, under certain conditions, excessive plate clouding. This latter problem is less pronounced in systems using higher rates of field reversal (about 1 Hz).

OBJECTS AND SUMMARY OF THE INVENTION

Therefore, the principal object of the invention is to control the dispensing of toner in xerographic processing systems such that toner particles will be added to developing material in amounts needed to obtain optimum developability over a wide range of operating conditions.

A further object of the invention is to provide a toner addition control system which reacts quickly to change in those operating conditions to maintain in optimum image quality during xerographic processing.

Another object of the invention is to determine and maintain at all times the proper ratio of toner-to-carrier in xerographic developing mixture.

Still another object of the invention is to better utilize the electrode fields and developer motion through a sensor to clean the sensor plates of the toner dispensing control.

Yet a further object is to prevent the loss of developability control in systems using light transmissive conductive plates attendent to excessive clouding of the plates under certain ambient conditions.

Still a further object is the provision of an electronic circuit for controlling an automatic developability system of the above type which is easy to construct and reliable in operation.

These and other objects of the invention are accomplished in a developability control system including spaced apart electrically conductive light transmissive plates between which an electric field is produced to cause development alternately on the plates of toner intermediate therebetween. A photocell is located to respond to light transmitted through the plates and generates a signal to inhibit the production of development fields when excessive clouding of the plates is detected. Inhibition of development fields permits more rapid cleaning of the sensor plates to prevent loss of control of the system.

This invention provides an electronic circuit for controlling a process monitoring arrangement such as a developability control arrangement wherein electronic gates respond jointly to oscillator produced pulse trains and to a process control signal indicating abnormal conditions to either alternately cycle switching transistors in response to normal process conditions or to hold the switching transistors constant until the abnormal condition has been corrected.

DESCRIPTION OF THE PREFERRED EMBODIMENT

Figure 1:
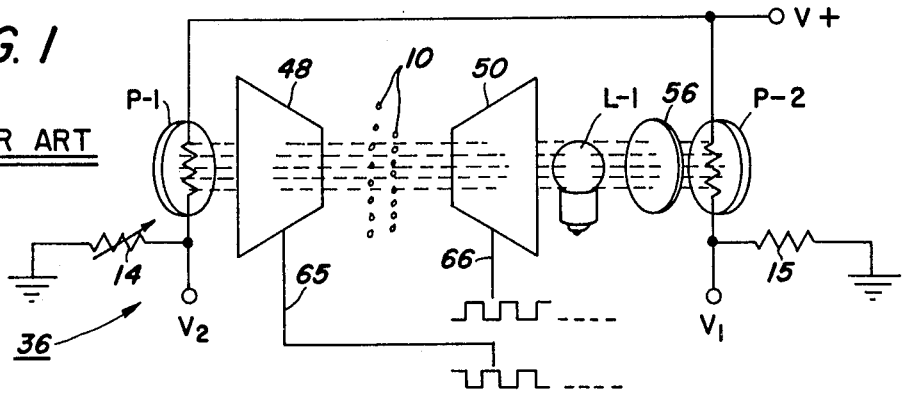
FIG. 1 PRIOR ART
FIG. 1 illustrates a prior art developability control arrangement with its associated electrical energization and sensing scheme.

Since the developability control arrangement of the type to which this invention is directed is well known and documented in the prior art, only a brief explanation of it will be given herein, reference being made to the above noted patents for a more complete operational description. Referring to FIG. 1 wherein a prior art system 36 is illustrated, developer material 10 is directed through a gap between two light transmissive electrically conductive plates or probes 48 and 50. The probes may be made of "NESA" (trademark of the Pittsburgh Plate Glass Company) glass which is tin oxide coated glass that is transparent to white light.

The sensor plates 48 and 50 are arranged in vertical planes and have a generally rectangular configuration. For practical purposes the plates may be of a size having approximately one-half inch for each side. The plates are arranged parallel to each other and spaced a short distance apart to form therebetween a gap. The gap between the plates 48, 50 may be on the order of one-tenth of an inch.

Developing material is made to flow by action of gravity or otherwise through the gap between the plates 48 and 50 and out of the bottom of the sensor for return to the development system. The developer material in most conventional xerographic machines comprises a mixture of "toner" or dry ink particles and "carrier" particles. The toner and carrier are mixed together to develop an opposite electrostatic charge of appropriate polarity, so that toner is attracted to the electrostatic latent image created on the electrostatic imaging or photoconductive surface of the associated reproduction machine. The mechanics of the xerographic system are well known and will not be presented here in any detail.

During the normal operation of the sensor 36 of the prior art, an electrical potential of a particular polarity to attract and retain toner particles is applied alternately to the plates 48, 50. This is accomplished by the application or biasing of the plates in a manner indicated by the voltage signals illustrated adjacent the lines 65 and 66 coupled to the sensor plates. As can be seen the signal trains to the plates are of the same magnitude, pulse width, and frequency, but are displaced in phase by 180°. The magnitude of the voltages between the plates is about 500 volts. From the nature of the pulse trains it is seen that as one of the plates is biased to attract toner particles, the other is biased to serve as a field defining development electrode and thus to repel toner particles therefrom. As each of the plates is alternately biased or charged positively and negatively with respect to the other plate during a cycle it will first attract toner for a short period of time and then subsequently repel the same toner. More specifically, in the prior art electrical energizing scheme of FIG. 1, each cycle is comprised of but two characteristic time frames and during each of these time frames toner particles are attracted to one or the other of the plates. Conversely, in the prior art there is never a time period during which both plates are biased so that neither attracts toner thereto.

It is to be understood that if toner particles in the development system are provided with negative charges the sensor plate which is positive with respect to the other plate will attract toner particles thereon. However, the sensor plates function equally well with either positively nor negatively charged toner with the same plate potential conditions.

The sensor 36 of the prior art also includes a first or test photocell P-1 positioned in close proximity to the side of the sensor plate 48 away from the space between the sensor plates. A lamp L-1 is also mounted in the sensor 36 and is arranged to close proximity to the side of the sensor plate 50 away from the spacing between sensor plates and in alignment with the plates and photocell P-1. The relative positioning of the photocell P-1 and the lamp is such that the photocell will receive the light rays of the lamp passing through the cascading developer material stream between the sensor plates and the accumulated toner on first and then the other, during each "attract" and "clean" cycle. The lamp is connected to a suitable source (not shown) of electrical power in the control circuit for effecting the energization of the lamp during sensing operation.

The sensor 36 of the prior art is also provided with a second or reference photocell P-2 located to receive illumination from lamp L-1 through a filter 56. It is preferably located on the side of the lamp L-1 remote from the first or active photocell P-1. The second photocell is of such characteristics and power and located from the lamp such that, when the two photocells are functioning in the yet to be described control circuit, the circuit will function to dispense toner into the developer only when the density of toner flowing through the plated 48 and 50 causes a signal to be generated from photocell P-1 which is a different by a preselected amount from the signal generated by the photocell P-2. This relationship is achieved herein by employing photocells P-1 and P-2 of the same characteristics located equidistant from the common source of illumination L-1 and by interposing an optical filter 56 between L-1 and the compensating photocell P-2. The filter 56 is of such opacity as to correspond to the opacity of the sensor plates during the times when they are electrostatically supporting toner from flowing developer of the desired optimum developability. Thus, the filter 56 is employed to establish and optimum signal from photocell P-2 which corresponds to optimum developability. When the signal from P-1 deviates from this amount by a preselected amount, additional toner is added.

The photocells P-1 and P-2 are connected to form separator legs of an electrical bridge, the resistors 14 and 15 forming the other legs of the bridge. The output of the bridge (the difference between $V_1$ and $V_2$ of FIG. 1) is fed to a comparator circuit (not shown) which provides a signal to energize a relay if the bridge output is greater than a preselected value. The relay is connected in series with a toner dispensing motor (not shown) to dispense toner into the developer mixture.

Thus, sensing control is accomplished in the prior art arrangement by continuously measuring the amount of toner particles that accumulates on both the plates 48 and 50 during multiple cycles of attract and clean actions. As previously indicated, a signal sensing cycle includes the time when one of the plates 48 and 50 attracts toner while the other repels it, and when the other plate attracts while the first attracting plate repels. Therefore, during a sensing cycle, each of the plates 48, 50 attracts toner particles for half the cycle time and each repels toner particles for the other half of the cycle.

The accuracy of the sensing system of the prior art is dependent on adequate cleaning of the sensor plates prior to each attract cycle for that particular plate. If toner accumulates on the plate from cycle to cycle the light transmitted through the plates ceases to be an accurate indicator of the developability characteristics of the developer mixture.

In the prior art arrangement cleaning was thought to be fully accomplished by the reversing of the polarity or sense of the field. Thus, the plate which is not in the attract mode has a repelling field for the like-charged toner, as determined by the difference in potential between the two plates. For example, cleaning will occur if the clean plate has a potential at ground or at a negative potential, or at a positive potential, but one which is less than that on the attract plate. If at a negative potential, cleaning will occur if the clean plate is less negative (that is, closer to zero) than the attract plate. As developing material cascades between the sensing plates, the material will clean away the toner particles previously attracted to that plate which is grounded. The effect of this arrangement results in an output of the photocell that is effectively a steady state condition, that is, except for ripples, the output is maintained at a fixed level for the purpose herein.

It has been found, however, that under certain conditions of humidity and temperature excessive clouding of the test plates occurs despite the continued reversal of the electric fields. This excessive clouding of the plates results in a low level of light transmittal therethrough to a sensing photocell which in turn shuts off the toner dispenser for a long period of time. Eventually, the depletion of toner in the developer mix results in a cleaning of the plates, but not until the concentration of toner is below specification resulting in poor copy quality. When the plates are eventually cleaned the system responds by turning on the toner dispenser but tends to overcompensate for the spent toner due to severe depletion in toner resulting from the long time period it has been off. These "undershoot" and "overshoot" periods of operation lead to a temporary loss of control of the development system.

Figure 2:
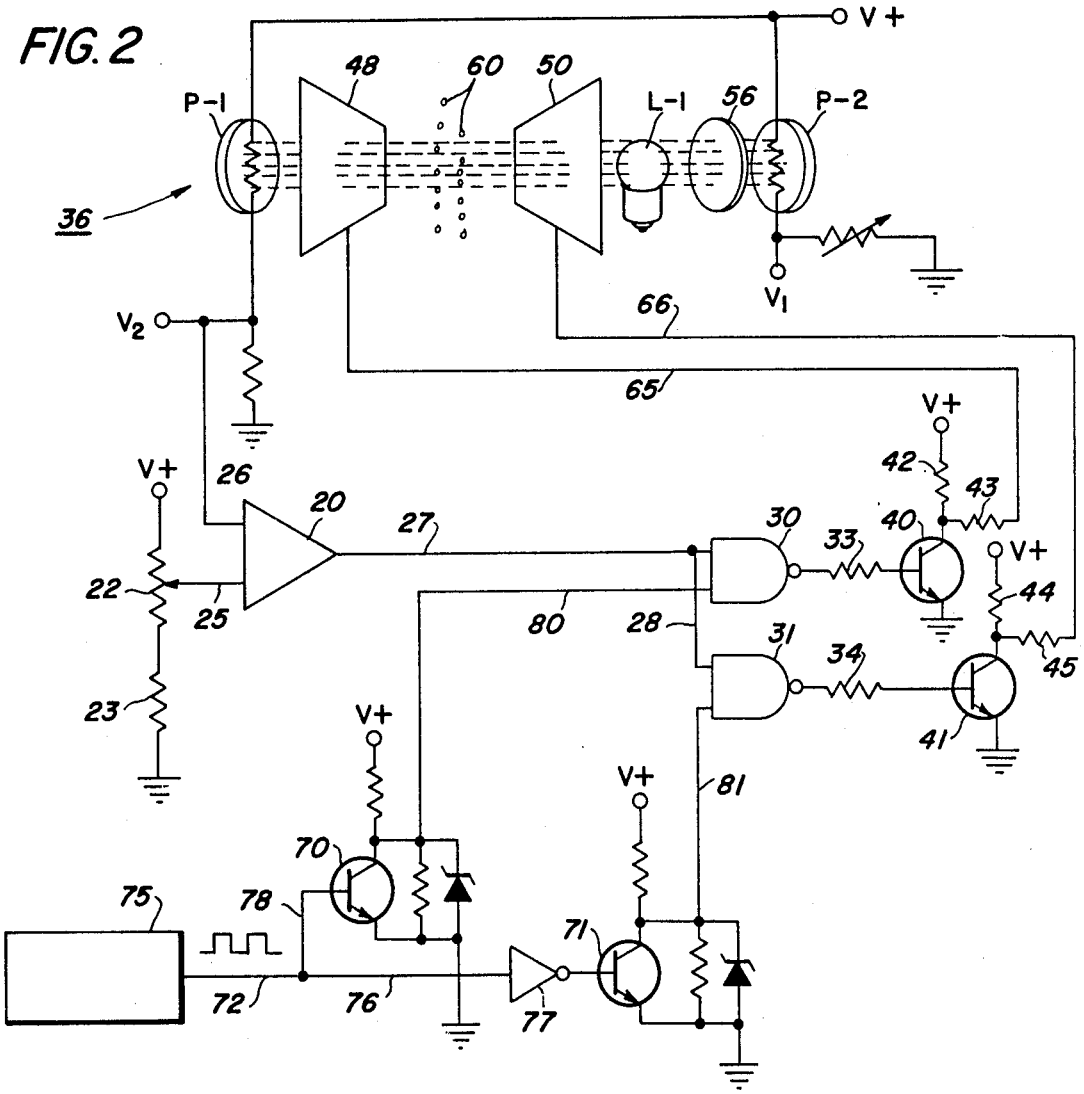
FIG. 2 illustrates the developability control system and a block diagram of the electronic circuit of the invention usable therewith.

Reference is now had to FIG. 2 which illustrates the system of the invention, the same reference numbers being employed to identify functionally equivalent elements.

The invention is based on the observation that when the toner deposited on the plates 48, 50 exceeds a certain level, the cleaning action normally provided by the reversing polarity of the fields between plates 48, 50 becomes inhibited. This leads to a temporary loss of control for a period sufficiently long to severely deplete the toner level. The invention under these conditions provides for a temporary overriding of the toner control until the clouding is reduced to a controllable level, by temporarily reducing the electric field between the plates to a level which will inhibit the deposition of toner on the sensor plates. With a low fied between the plates 48, 50 more rapid cleaning is promoted and loss of developability control is avoided.

The above is accomplished in accordance with the circuit of FIG. 2 which includes switchable transistors 40 and 41 which operate to control the electric fields between the plates 48 and 50.

Transistor 40 has its collector coupled to a d.c. supply voltage V+ through resistor 42 and its emitter grounded. The collector of transistor 40 is also coupled to plate 48 via resistor 43 and line 65. When transistor 40 is on or conducting, a low voltage is applied to plate 48, and when transistor 40 is off, a high positive voltage is applied to plate 48. The turning on and off of transistor 40 is controlled by the NAND gate 30 which is connected to the base of transistor 40 via resistor 33, explained hereinafter.

Transistor 41 in a fashion analogous to transistor 40 has its collector coupled to a positive d.c. supply via resistor 44 and its emitter coupled to ground so that when turned off it applies a high potential to plate 50 via line 66 and when turned on it applies a low potential to plate 50. Transistor 41 is switched between its on and off states by NAND gate 31 which is coupled to the base of transistor 41 via the resistor 34.

The parameters for the transistors and the resistors 40 and 41 are selected so that when they are turned on a voltage slightly above ground is applied to the plates and when turned off a voltage of approximately 500 volts is applied thereto.

Comparator 20 has a first input coupled to potential $V_2$ via conductor 26. As noted previously, $V_2$ varies according to the amount of toner present between the plates 48 and 50. $V_2$ increases when the amount of toner between the plates 48 and 50 decreases, which in turn, causes more light to impinge on P-1 to decrease its resistance. Conversely, as toner between the plates 48 and 50 increases, light impinging on P-1 decreases resulting in a greater resistance of P-1 and a decreasing potential $V_2$.

The other input to the comparator 20 is coupled via line 25 to a tap on a variable resistor 22 which, with the resistor 23, forms a voltage divider provides a reference potential $V_3$ on line 25 which corresponds to a point at which, through experiment, control of the automatic developability control system is lost due to excessive clouding of the sensor plates.

The output of the comparator 20 on line 27 is a high positive voltage or a low voltage depending on the difference between the potentials $V_2$ and $V_3$. As long as $V_2$ remains a preselected amount above the $V_3$, the output of the comparator is a high positive value. But when $V_2$ drops sufficiently close to or below $V_3$, the output of the comparator 20 switches to a low potential. Thus, comparator 20 provides a low output whenever the override function of the invention is to be activated and a high output at all other times.

The output of the comparator 20 on line 27 is fed to each of the NAND gates 30 and 31 via lines 27 and 28. The other inputs to the NAND gates 30 and 31 originate from the switching signal generator 75 which provides a pulsating d.c. signal at a preselected frequency on line 72. A standard commercially available oscillator may be used to provide, for example, a 0.28 Hz, 5 volt signal having a 50% duty cycle. The signal on line 72 is applied directly to transistor 70 via line 78 to turn it on when the signal on line 72 is high, and to turn off transistor 70 when the signal on line 72 is low. Thus, transistor 70 turns on and off at the same rate and for the same duration corresponding to the occurrence of a high potential on line 72. With transistor 70 turned on, its collector is only slightly above ground and a low level signal is applied to the NAND gate 30. With transistor 70 off a high potential is applied to NAND gate 30 via line 80. In a similar fashion the output of the signal generator 75 via lines 72 and 76 is applied to transistor 71 via an inverter 77. As can be easily understood, application of the switching signal through the inverter 77 results in the transistor 71 being turned on when the switching signal from the switching signal generator 75 is low and being turned off when the switching signal from the switching signal generator is high. Thus, transistor 71 is turned on when the transistor 70 is off and it is turned off when the transistor 70 is turned on. The output or collector side of transistor 71 is coupled as an input to NAND gate 31 via the line 81.

As in the prior art arrangement, the output of the bridge ($V_2 - V_1$) operates a separate comparator (not shown) to dispense toner into the development system.

During normal operation of the FIG. 2 arrangement the photocells P-1 and P-2 continuously monitor the light from the source L-1 through the plates 48, 50 and the filter L-1 respectively. Normal conditions are those present when the plates 48, 50 are not so clouded as to trigger the override circuit of the invention and are characterized by a $V_2$ potential which may be slightly higher or lower than $V_1$, but not sufficiently low to cause comparator 20 to trigger its output from a high potential to a low potential. As noted hereinbefore, the $V_2$ level which comparator 20 is triggered is set by observation of loss of control in response to overclouding.

Since a high output is present on line 27 under normal conditions, each of the NAND gates 30 and 31 has one high input under normal conditions. Thus, since the lines 80 and 81 from the transistors 70 and 71 are alternatively changing between high and low potentials, the NAND gates 30 and 31 will be switched alternatively at the same rate as the generator 75; only one providing a high output at any given time. The NAND gate having two coincident high inputs at any given time produces a low output, the low output being fed to its associated switching transistor 40 or 41 to turn it off, and thereby causing a high positive potential to be applied to its associated NESA plate, as explained hereinbefore. The NAND gate with coincident high and low inputs in a similar fashion turns on its associated NESA plate. Thus, under normal conditions pulse trains similar to that shown in FIG. 1 are applied to plates 48 and 50.

The bridge output ($V_2 - V_1$) is sensed by a comparator (not shown) to turn on a dispensing motor only when $V_2$ is greater than $V_1$ by a preselected amount. This latter condition ($V_2 > V_1$) is caused by more light impinging on P-1 which is indicative of low toner concentration. As toner is dispensed in response to the low toner condition, the toner concentration in the developer mixture flowing through the sensor increases, resulting in more toner deposition on the plates 48, 50 and less light impinging on P-1. This, in turn, reduces $V_2$ to a level below the toner dispensing level, which turns off the dispenser. The above process is thus characterized by a movement of $V_2$ upward and downward between definite manageable limits.

However, through experience, it has been noticed that if $V_2$ drops to a level significantly lower than $V_1$, or stated differently if $V_2$ drops below a certain absolute limit resulting from excessive clouding, loss of system control results. Thus, instead of the toner dispenser being turned on and off for short time periods, as accompanies normal operation, both the on and off times become excessively long resulting alternatively in overcompensation and undercompensation which deteriorates copy quality.

To alleviate this situation, the potential $V_2$ is continuously monitored by the comparator 20. Thus, when the value of $V_2$ drops below a preselected level the override feature of this invention comes into play. Specifically, under conditions of excessive clouding, the light impinging on P-1 decreases resulting in a decrease in $V_2$. When $V_2$ decreases below a preselected level (relative to $V_3$) comparator 20 is switched to provide a low potential on lines 27 and 28. This, in turn, translates into a low input to both NAND gates which maintains both transistors 30 and 31 in a conductive state. With transistors 30 and 31 conducting the development field across the plates 48, 50 is terminated.

Stated differently, when the comparator 20 senses the drop of $V_2$ below a preselected limit, NAND gate 30 and 31 are prevented from alternately switching between high and low outputs in response to the signal generator 75.

The override circuit maintains a low field (plates 48 and 50 are at approximately ground potential) on the plates 48 and 50 until the voltage $V_2$ rises above the override level at which time comparator 20 is again switched to a high output permitting the cycling action of the transistor 30 and 31 as explained hereinbefore.

The temporary inhibition of the electric field across the plates 48, 50 in the override condition fosters rapid cleaning of the plates due to the scavenging action of the developer flowing through the sensor 36.

It should be noted that while both plates 48 and 50 are substantially grounded or reduced as shown in the embodiment of FIG. 2 to the same low level in the override condition, it is equally feasible to apply high potentials of substantially the same magnitude to both plates. This also reduces the development field to a level whereby scavenging may take place at a rapid rate. Similarly, while the total absence of an electric field between the plates is best for cleaning, a low field substantially below that needed to cause deposition of toner on the plates may also be utilized.

It is thus appreciated that the electronic control arrangement of the invention provides a pair of switchable biasing transistors 40 and 41 which under normal process conditions are turned on and off alternately, the one transistor being on while the other is off. Under abnormal conditions both transistors are turned on to apply constant and substantially equal bias voltage to the plates 48 and 50.

The above action is produced by electronic gates 30 and 31 which cooperate with an oscillator switching means including the oscillator 75, transistor 70 and 71 and inverter 77 to alternately cycle the transistor 40 and 41 or hold them constant depending on the presence or absence of a control signal from comparator 20 indicating excessive clouding.

The exact circuitry of FIG. 2 may of course be modified by one skilled in the electronics art without departing from the spirit and scope of the invention. For this reason, it is intended that this invention be accorded a scope consistent with the appended claims.

What is claimed is:

1. A process monitoring circuit for generating a periodically reversible bias across electrodes under normal process conditions and for developing constant low intensity field under abnormal conditions comprising:

a comparator for generating a first signal in response to normal process conditions and a second signal in response to an abnormal condition, a pair of electronic gates, each gate having first and second inputs and an output, the output of the comparator being coupled to said first gate inputs, oscillator switching means for providing two pulse trains, each train characterized by first and second voltage levels, said trains displaced in phase by 180°, said trains being coupled to said second gate inputs, the gates providing, in response to said first signal from the comparator, two pulse trains of a character similar to those received from the oscillator switching means, and, in response to said second signal, a constant level signal, and switching means coupled intermediate the gates and the electrodes and responsive to the pulse train output of the gates to periodically apply reversible biases to the electrodes, and responsive to the constant level gate output to apply constant equal biases to each electrode.

2. The combination recited in claim 1 wherein said oscillator switching means comprises an oscillator, said oscillator coupled along a first parallel path to one of said second inputs of the gates and along a second parallel path through an inverter to the other of said second inputs.

3. The combination recited in claim 2 wherein said oscillator switching means further includes first and second transistor switches, the first coupled intermediate the oscillator and one of said second inputs, and a second transistor coupled intermediate said inverter and the other of said second gate inputs.

4. The combination recited in claim 1 wherein said electronic gates are NAND gates.

5. The combination recited in claim 1 wherein said switching means comprises first and second transistors having their collectors coupled to said electrodes and their bases coupled to said gates.

* * * * *